US008011358B2

(12) United States Patent
Galindo et al.

(10) Patent No.: US 8,011,358 B2
(45) Date of Patent: Sep. 6, 2011

(54) DOUBLE FLAME PERIMETER BURNER

(75) Inventors: Victor Gerardo Caloca Galindo, Queretaro (MX); José Arturo Lona Santoyo, Queretaro (MX); Roberto Cabrera Botello, Queretaro (MX)

(73) Assignee: Mabe Mexico S. DE R.L. DE C.V., Queretaro (MX)

( * ) Notice: Subject to any disclaimer, the term of this patent is extended or adjusted under 35 U.S.C. 154(b) by 307 days.

(21) Appl. No.: 12/034,035

(22) Filed: Feb. 20, 2008

(65) Prior Publication Data

US 2008/0202495 A1 Aug. 28, 2008

(30) Foreign Application Priority Data

Feb. 23, 2007 (MX) ..... MX/A/2007/002289

(51) Int. Cl.
*F23D 14/06* (2006.01)
*F23Q 3/00* (2006.01)

(52) U.S. Cl. ..... 126/39 E; 126/39 H; 126/39 R; 126/40; 431/266; 431/264; 431/283; 431/60; 431/278

(58) Field of Classification Search ..... 431/283, 431/286, 39 E, 354; 239/548, 549; 126/39 E, 126/39 R, 39 H
See application file for complete search history.

(56) References Cited

U.S. PATENT DOCUMENTS

| | | | | |
|---|---|---|---|---|
| 1,130,747 | A | 3/1915 | Lozano | |
| 2,898,979 | A * | 8/1959 | Hollman et al. | 431/283 |
| 5,133,658 | A * | 7/1992 | Le Monnier De Gouville et al. | 431/349 |
| 5,328,357 | A * | 7/1994 | Riehl | 431/266 |
| 5,492,469 | A * | 2/1996 | Oda et al. | 431/266 |
| 5,842,849 | A | 12/1998 | Huang | |
| 6,132,205 | A | 10/2000 | Harneit | |
| 6,325,619 | B2 * | 12/2001 | Dane | 431/284 |
| 6,332,460 | B1 | 12/2001 | Paesani | |
| 6,435,173 | B1 | 8/2002 | Miller | |
| 7,001,176 | B2 | 2/2006 | Bettinzoli | |
| 7,527,495 | B2 * | 5/2009 | Yam et al. | 431/283 |
| 2003/0087214 | A1 * | 5/2003 | Welton et al. | 431/286 |
| 2004/0224274 | A1 * | 11/2004 | Tomiura et al. | 431/354 |
| 2005/0142511 | A1 * | 6/2005 | Yam et al. | 431/285 |

FOREIGN PATENT DOCUMENTS

| | | |
|---|---|---|
| MX | 191876 | 4/1999 |

* cited by examiner

*Primary Examiner* — Steven B McAllister
*Assistant Examiner* — Nikhil Mashruwala
(74) *Attorney, Agent, or Firm* — Enrique J. Mora; Beusse Wolter Sanks Mora & Maire P.A.

(57) ABSTRACT

A burner for range covers or similar, to allow a broad range of calorific capacities, and a better burner distribution in the cover, with a generally semi-rectangular form, and containing a plurality of ports and a plurality of manners to ignite it, wherein the burner is capable of interacting with other burners at determined length and height distances, creating discontinuous flames between the burners.

11 Claims, 14 Drawing Sheets

Funcionamiento del Quemador - Válvula a
b
c
2
10
11
12
21
30
35
38
H
Z

DOUBLE FLAME PERIMETER BURNER

RELATED APPLICATIONS

This application claims priority to Mexican application Serial No. MX/a/2007/002289 filed Feb. 23, 2007, which is incorporated herein by reference in its entirety.

FIELD OF THE INVENTION

The invention refers to systems and apparatus for cooking in general, such as range, grills, grates, cookers or cook tops or similar, and in a more specific manner to conventional burners with or without bridges to provide a variety of heating configurations according to the necessities of the operator of the range, grate, stove, grill, cooker or similar.

BACKGROUND OF THE INVENTION

Range, grate, stove, grill, cooker or cook tops covers that include one or more burners in the same axis are known in the art. It is common that a main burner may have a maximum thermal capacity of about 4,229 kilojoules (4,000 BTU) to about 10,600 kilojoules (10,000 BTU) an hour in its highest position. The minimum thermal capacity of a burner may be reduced to about 633 kilojoules (600 BTU) an hour without flame extinguishment. It is logical that the ring diameter of the flame, determines the heat output coefficient of the burner.

A higher output coefficient, may be solved by the multiplicity of burners, or by orbital burners, such as star or concentric ring burners, which have several heat outputs in the same burner.

Examples of the above exist in the prior art. U.S. Pat. No. 5,842,849 discloses a gas burner includes a base member to which a plurality of nozzles is disposed and a disk is mounted to the base member with a plurality of gas supplying tubes connected between the disk and the base member. A central head member and a plurality of chambers are respectively mounted to the disk and communicate with the gas supplying tubes respectively. Each of the chambers and the central head member has a plurality of openings defined therethrough.

Mexican Patent No. 191876 discloses that by means of burner design in the form of an oval, and by means of port design, a greater space to the average space of a burner may be burnt, providing greater thermal capacity (BTU's).

U.S. Pat. No. 6,132,205 incorporates a multi-ring burner assembly utilizing at least two flame rings to gently and evenly warm food and a third flame ring in conjunction with the first two flame rings for cooking food. This design has the further advantages of easy replacement of both the igniters and the gas jets from the top of the appliance without having to remove the unit from the appliance.

U.S. Pat. No. 6,325,619 discloses gas burner with multiple gas rings comprising: a burner body mountable underneath a top plate, with a cut-out section, of an appliance and incorporating a first, upwardly directed gas injector and a second gas injector followed by a horizontal tubular Venturi opening into a vertical well; an outer burner head seated on the body through the cut-out section and spaced at a distance above the plate and provided with an annular chamber open above the well and having one or two rows of orifices for flames; and an inner burner head shaped so as to have a radial divergent coaxially supplied by the first injector through a recess located at the center of the head, ports being provided in the head so that all the primary air and the secondary air needed to operate the multiple burner arrives from the top of the top plate of the appliance.

Another manner by which to provide greater heat than that of a normal burner, is disclosed in U.S. Pat. No. 6,332,460, wherein a gas burner assembly particularly for incorporated cooking hobs in a gas cooker, has at least two nozzles selectively feedable to form corresponding gas/air mixtures in two separate mixing chambers provided with flame orifices, said flame orifices being positioned on two different levels. The burner assembly is selectively operable to provide a full range of gas cooking powers.

U.S. Pat. No. 6,435,173, discloses a combined burner and grate structure for use in connection with a gas range includes one or more burner elements. Each burner element has one or more fuel inlets, one or more fuel outlets disposed on one or more side surfaces, and a top surface. A horizontal planar support for a cooking vessel is made up of the top surface of each burner element. A gas rangetop can include one or more of these combined burner and grate structures.

Another patent disclosing ring burners is U.S. Pat. No. 7,001,176, which discloses a burner for cookers, suitable for burning gas, comprising at least two gas crowns, of which one central one and at least one circumferential one, a mixing chamber with Venturi effect, ducts for entry of the primary air and radial ducts for feeding the gas/primary air mixture to the said at least one circumferential crown, comprising a body, a head and a separation element that breaks up the internal space into ducts for entry of the primary air and ducts for distribution of the gas/primary air mixture.

Finally, U.S. patent application Ser. No. 10/967,537 with publication No. US 2005/0142511 discloses another manner by which to supply greater thermal or calorific capacity to a burner. Said publication discloses multiple gas burner assembly has two burners spaced apart by a bridge burner. An axis extending through the first and third burner intersects the perimeter of the bridging second burner. The second burner provides a means for providing a substantially continuous flame perimeter and continuous heating intermediate the first burner and third burner when the three burners are lit. This publication is the closest state of the art found. However, one of the differences between said publication and the invention, is that the distance between the main burner, the secondary burner and the satellite burner, has such a distance, that allows lighting the satellite burner through the main burner, avoiding that the flames of both burners have interference, causing a bad appearance in the flame and greater carbon monoxide production. In FIG. 12 of said application, a similar figure to that of the present invention is disclosed. However, it should be noted from the specification of the application, specifically in page 4, paragraphs 45 and 46, that the invention in this embodiment was not carried out. It should be noted that the intermediate burner in the embodiments of FIGS. 10 through 13 of the application, do not have a proper form of ignition, nor do they have an adequate form of burning.

BRIEF DESCRIPTION OF THE INVENTION

One of the problems found in current ranges, grates, stoves, grills, cookers or cook-tops, is that they have fixed predetermined areas for cooking by means of fixed burners, the user selecting between said fixed predetermined areas which of the burners will be used.

Another problem found in current ranges, grates, stoves, grills, cookers or cook-tops, is that said fixed predetermined areas for cooking are not provided with sufficient thermal capacity to heat or cook in a uniform manner a crock, griddle or other cooking utensil, that has a greater dimension than the burning area of the burner, and thus the crock, griddle or other cooking utensil has to be rotated and moved.

A further problem found in current ranges, grates, stoves, grills, cookers or cook-tops, is that there are no burners having cooperation amongst themselves, allowing the user to select the burners to be used and the quantity of burners to be used.

Therefore, an object of the present invention is providing a burner assembly which includes at least two different burners in the same axis, for better cooking and heating of the user's food.

A further object of the invention is providing sufficient thermal capacity to heat or cook in a uniform manner the contents of the crock, griddle or similar, that has a greater dimension to that of a fixed cooking area.

Yet a further object of the invention is providing burners having cooperation amongst themselves, allowing the user to select the burners to be used, and the quantity of burners to be used.

A further object of the invention is that a predetermined distance between the main burner and the secondary burner in regards to a third burner exists, so that the flames of the burners have no interference.

Another object of the present invention is providing a range, grate, stove, grill, cooker or cook-top with a multiplicity of burners, so that the user selects the burner or burners that said user requires.

Another object of the invention is providing burners that have cooperation amongst themselves, and that said burners are easy to produce, assemble, clean and give maintenance to.

Another object of the invention is carrying out a port design, that may be used with the above-mentioned burners.

Finally, another object of the invention is providing ranges, grates, stoves, grills, cookers or similar, with the burner of the present invention.

BRIEF DESCRIPTION OF THE DRAWINGS

The particular characteristics and advantages of the invention, as well as other objects of the invention, will be known from the following specification, in connection with the accompanying figures, which.

DETAILED DESCRIPTION OF THE INVENTION

Users of gas ranges, grates, stoves, grills, cookers or similar require that the range, grill, etc. cover has in its cover burners of such geometry and disposed in such a manner, that allow the user to have great flexibility to heat there utensils, which may vary in size and form, not only being round, but also with a squared, rectangular, semi-spherical (wok's), irregular, in a star-shaped form, etc. base. Furthermore, the problem complicates if we consider the different measures of the cooking utensils and different heating capacities required to transmit from a burner (or a burner assembly) to the cooking utensil, depending on the platter, ingredients, cooking recipe, or further variables of the cooking aspect.

The present invention intends providing a range, grill, etc. cover, of burners which may give a broad heating capacity range, as well as a better burner distribution in the cover, which allow receiving a great cooking utensil geometry variety.

First Embodiment of the Invention

Figure 1:
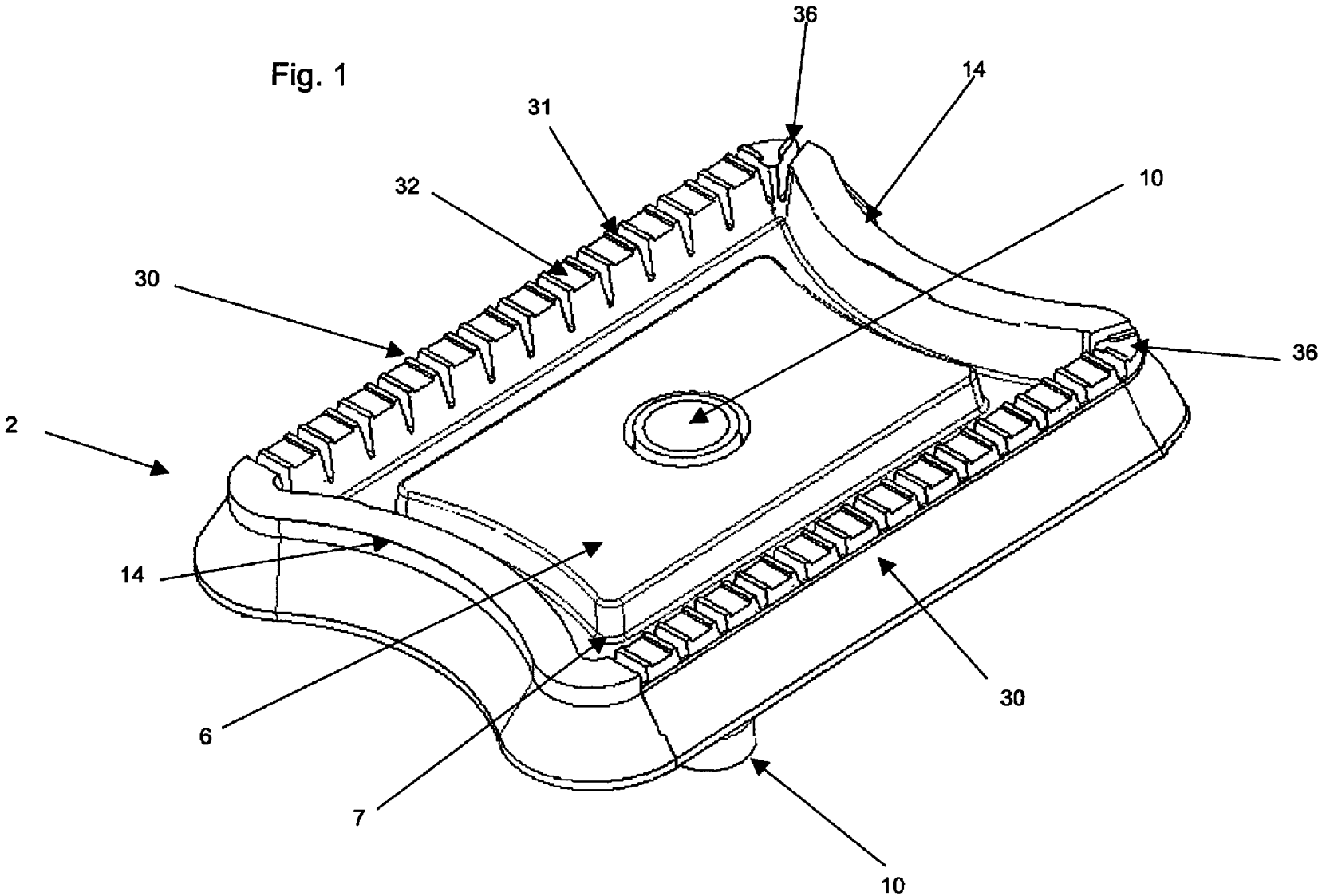
FIG. 1 is an isometric superior view of the burner of the present invention.

FIG. 1 shows an isometric superior view of the satellite burner 2 of the present invention, said burner has a semi-rectangular form, showing in its longer sides port zone 30 longitudes. In its perpendicular sides, the satellite burner 2 has a neck 14 or an arc segment, to cooperate in its ends with the main burners 1, which preferably have a round geometry.

Figure 3A:
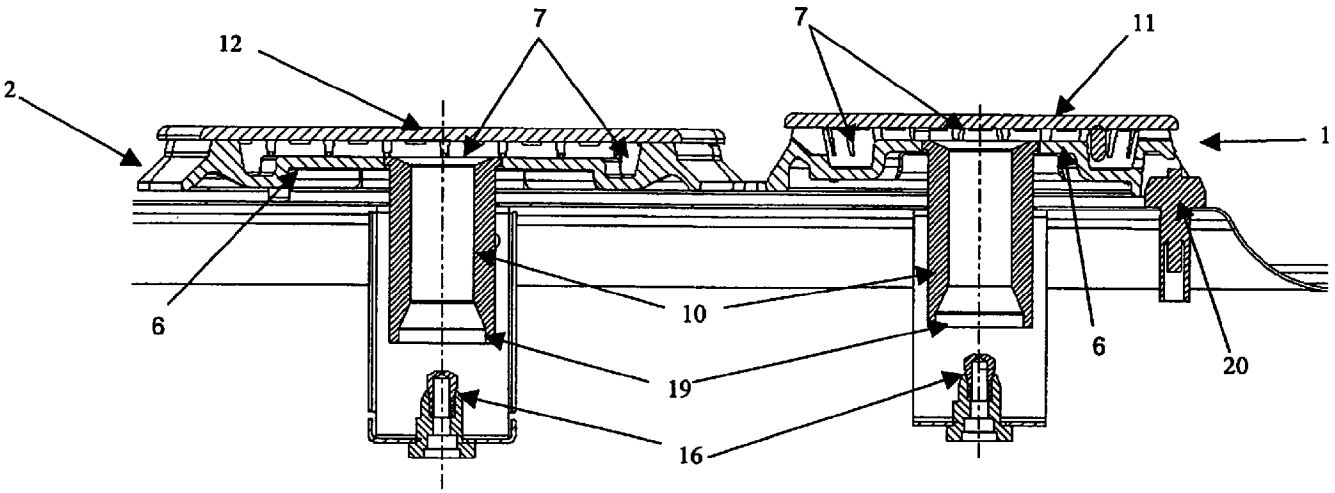
FIG. 3*a* is a cross-section front view of the burner components of the present invention and a burner configuration.

As appreciated in FIG. 3*a*, a mixer or Venturi tube 10 allowing the fuel gas mix, coming from flow regulating valves 15, to be directed to a nozzle 16, which reduces the pressure and allows a determined flow velocity. The mixer tube 10 embraces the nozzle 16 by means of a throat 19, which may be above said nozzle 16, so that the flow coming from the nozzle 16 may be introduced to the mixer tube 10, generating a Venturi effect dragging the air around, introduced by the windows 18. The mixer tube 10 has a regulating ring (not shown), which restricts the air pass to the interior of the mixer tube 10, to modify the air-fuel relation of the mixture.

Figure 3B:
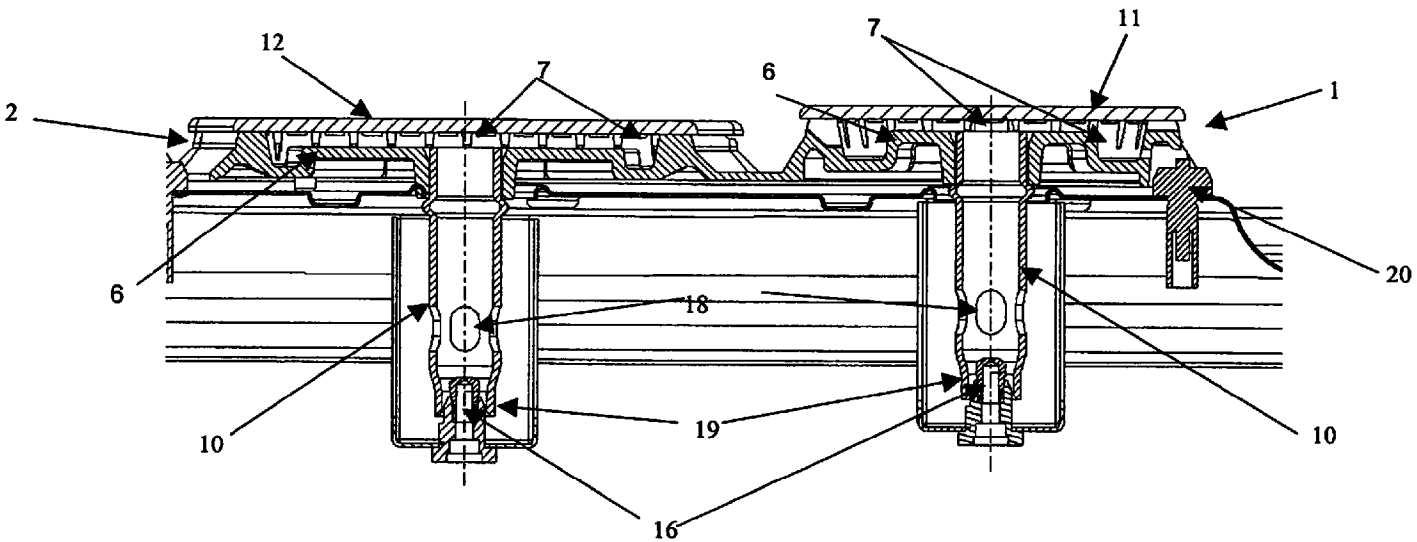
FIG. 3*b* is a second cross-section front view of an embodiment of the burner of the present invention and a burner configuration.

Another embodiment of the mixer tube 10 which may be used with the burner or burner assembly of the present invention is shown in FIG. 3*b*, such as a short conical tube in its interior, which does not embrace the nozzle 16, rather between said nozzle 16 and mixer tube 10, there exists a certain distance allowing air admission by Venturi effect, while air is dragged or introduced by the broadest part of the conical mixer tube 10 thanks to the velocity set by the nozzle 16 to the fuel fluid; the mixed fluid with fuel and air, is guided through the internal body of the mixer tube 10 until reaching the burner 2 body, which has an internal chamber 7 for uniformly distributing the fuel-air mixture.

The chamber 7 has an internal plateau 6, which reduces the chamber space to uniform and speed the fuel-air mixture flow. Therefore, in general the burner ports, which will be detailed further ahead, will have the same flow velocity so that the flames are similar.

Figure 2:
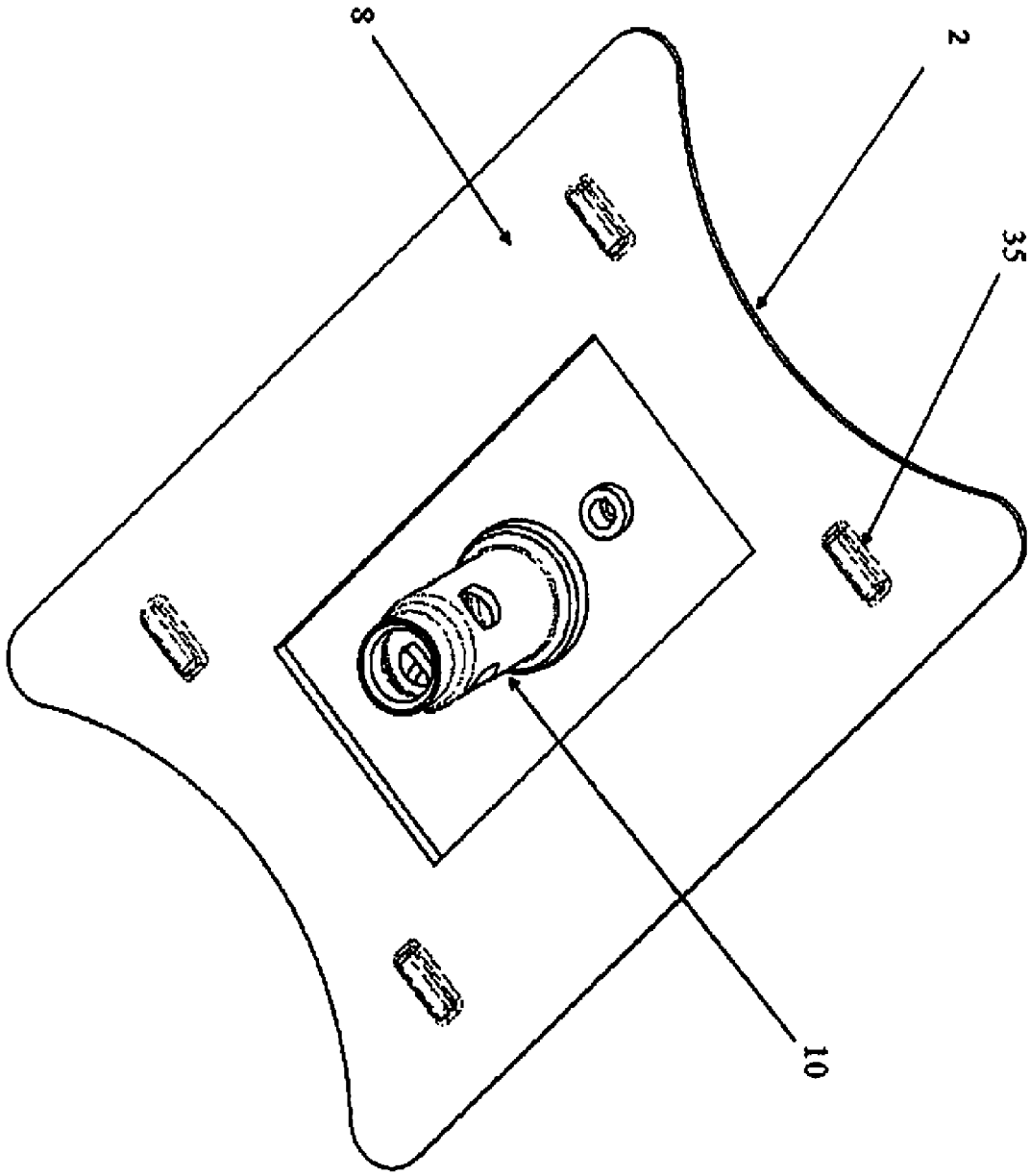
FIG. 2 is an isometric inferior view of the burner of the present invention.

FIG. 2 shows an inferior isometric view of the burner 2 of the present embodiment, wherein support ingots 35 are shown, over which the satellite burner 2 body rests. The assembly between the mixer tube 10 and the satellite burner 2 body is also shown, which may be fixed by any type of mechanical fixation, such as: dimensional interference, jogged, riveted, by means of an agglutinant, etc.

Figure 4:
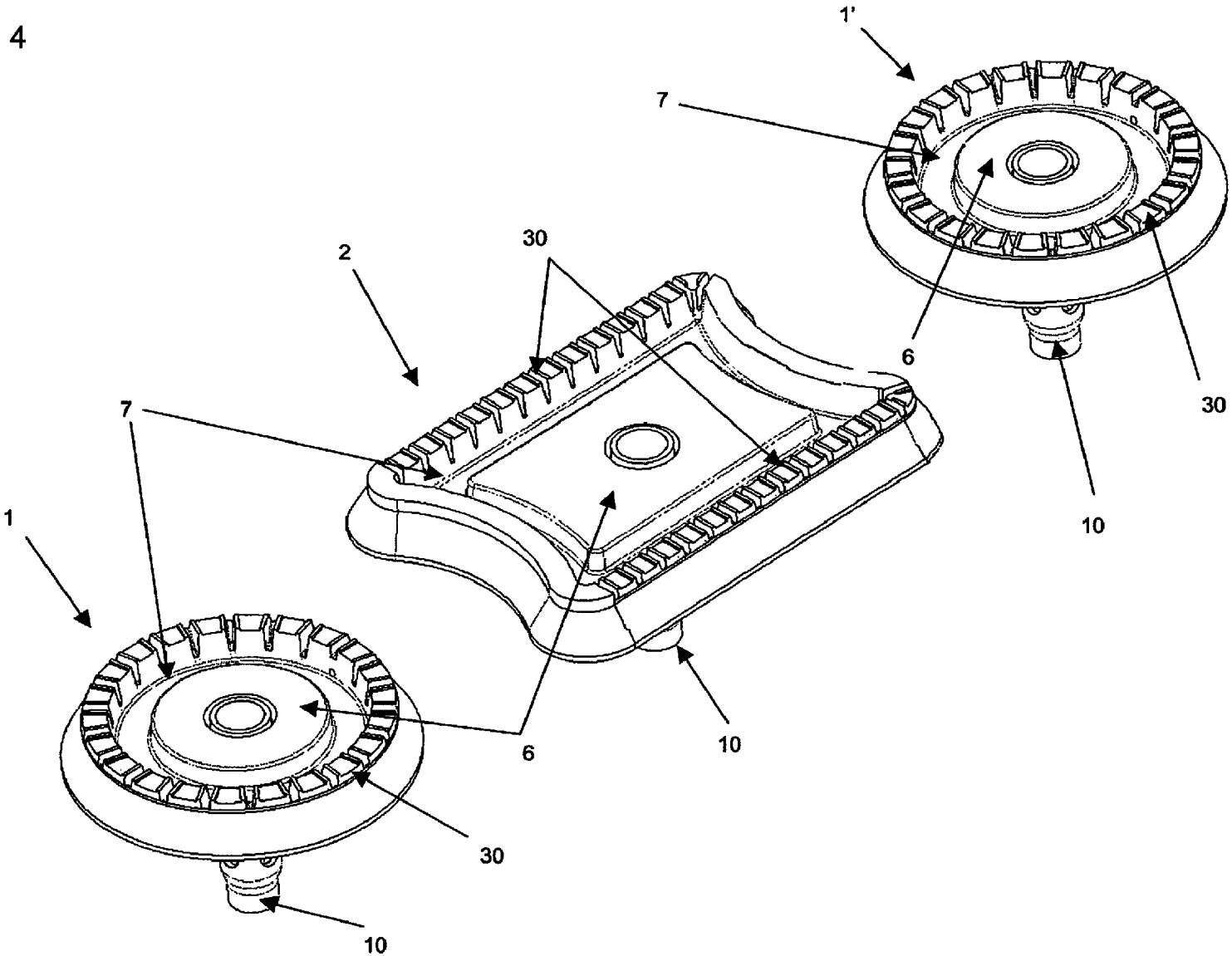
FIG. 4 is an isometric view of a possible burner configuration.

FIG. 4 shown an isometric view of a possible burner configuration, specifically three burners 1, 2, 1' in line, wherein in the center the satellite or secondary burner 2 is found, and in the ends, the two main burners 1, 1'. This configuration allows obtaining a greater heating area on a single axis, allowing heating utensils of bigger size, such as a tamale crock, tortilla griddle, etc., which require of a uniform high calorific quantity throughout an axis, so that the griddle has a greater heating surface area, heating a greater quantity of tortillas, tamales or other food. Three pans or a big pot and a pan may be heated at the same time. It may be appreciated that a broad range of cooking utensil combinations, which may require different calorific capacities may be heated with this combination. The configuration or assembly, allows the satellite burner 2 to interact with at least one main burner 1 or 1', since in a preferred circumstance, a main burner 1 or 1' and the satellite burner 2 are connected to a common flow regulating valve 15 having to fuel exists to each burner 1 or 1' and 2 respectively.

Figure 5:
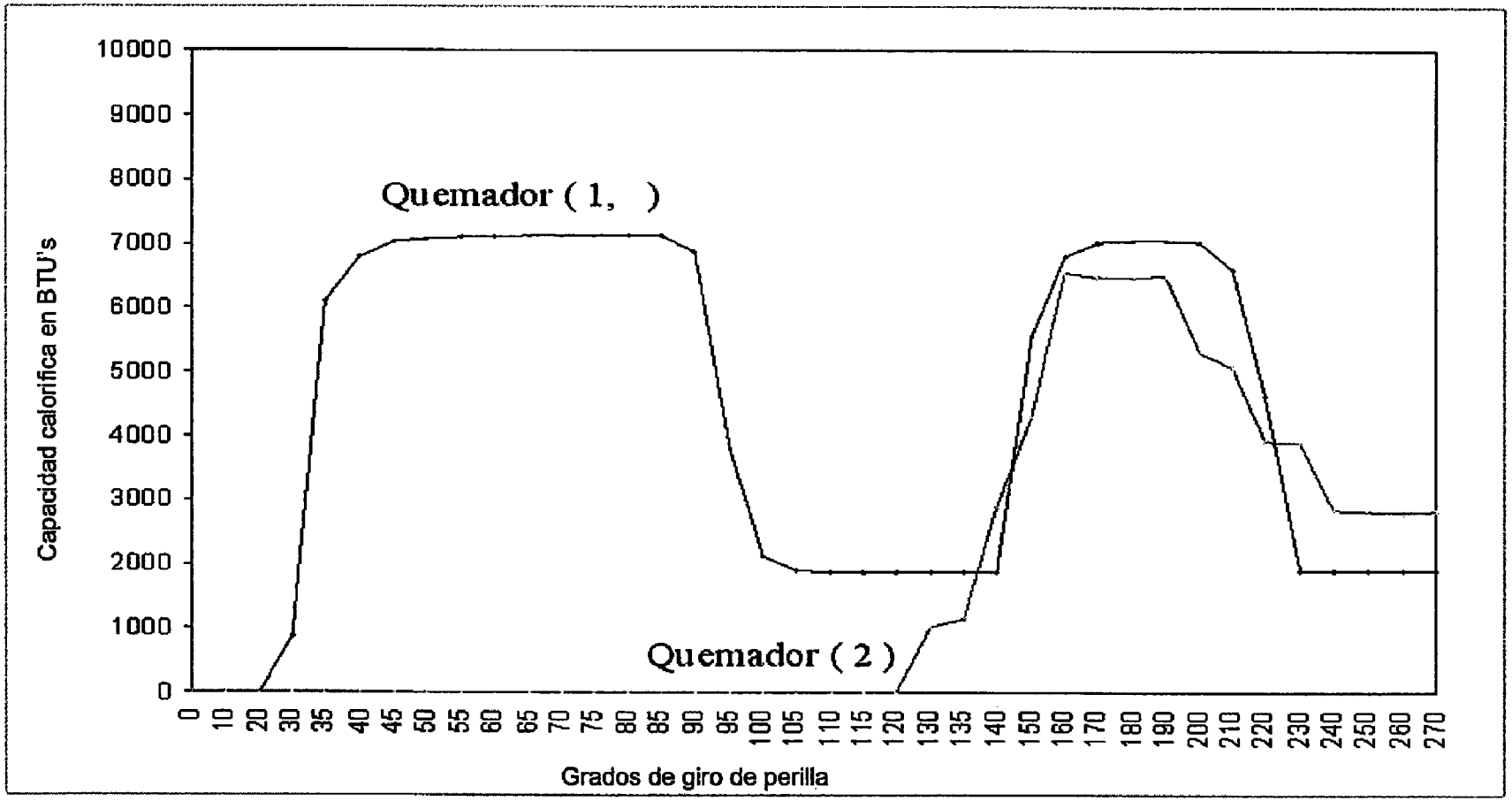
FIG. 5 is a graph illustrating the rotation angle of the knob vs. the fuel flow.

FIG. 5 illustrates the rotation of the knob vs. fuel flow emitted by the valve (in calorific capacity, knowing that the relation is somewhat linear, a greater calorific capacity requires greater fuel flow). The valve 15 controls the main burner flame 1, so that when the knob is found in a closed position in a zero grade rotation, the valve 15 does not supply fuel flow to the burners. When the knob is rotated approximately ninety degrees, the valve 15 supplies the maximum fuel flow to the main burner 1. Continuing with the rotation in the same sense, approximately at hundred and thirty degrees of rotation, the fuel flow supplied by the valve 15 to the main burner 1 is minimal. Continuing with the rotation in the same sense, approximately at two-hundred degrees of rotation, the valve supplies a maximum fuel flow to both burners 1 and 2, igniting the satellite burner 2 through flame transfer ports 36, located at the nearest ends of the main burner 1. When the flame transfer ports 36 are ignited, these transfer the flame to the rest of the ports 31 and 32 in the port zone 30 of the satellite burner 2. Continuing with the knob rotation in the same sense, reaching the rotation limit of the valve 15, approximately at 270 degrees of rotation, the valve 15 allows a minimum fuel flow to the burners 1 and 2.

Another operation mode of the present embodiment, is given when giving the satellite burner 2 a pair of sparks 20, each spark 20 for each port zone 30. Additionally, an independent valve 15 for each burner is needed, making the transfer ports 36 unnecessary. Additionally, it is preferable that in this operation mode a knob per valve 15 exist for better functioning.

The proposed geometry should not be understood as limitative or constrain the invention in any of its embodiments to this particular port configuration, since the invention is designed to work with a determined port area between five square millimeters (0.00775 square inches) to seven square millimeters (0.0109 square inches) for the main ports 31, between three square millimeters (0.00465 square inches) to six square millimeters (0.0093 square inches) for the secondary ports 32, and between one square millimeter (0.00155 square inches) and three square millimeters (0.00465 square inches) for the flame transfer ports 36. Therefore, the ports may be round, squared, or have any geometry having a port area limited to the above-mentioned, and a separation amongst themselves, giving a finite and calculable number, from the periphery of the port zone 30 of the satellite burner 2, in which case, the total port area has a range of one square centimeter (0.155 square inches) to three square centimeters (0.465 square inches).

The mass output gas fuel flow mixed with primary air, is bound to the port area, regulating the pass of said fuel flow and mixed primary air. The calorific capacity of a burner is in function of, among others, the port area, as well as the performance of the burners, since when mixing the gas mass flow through a determined area, its speed is modified and thus the stability of the flame is affected by the dimension of the part area. The calorific capacity, along with the port area, define the port load, which is the amount of kJ/Hr (BTU/Hr) emitted by the burner by area unit kJ/Hr*mm$^2$ (BTU/Hr*inch$^2$).

Figure 6:
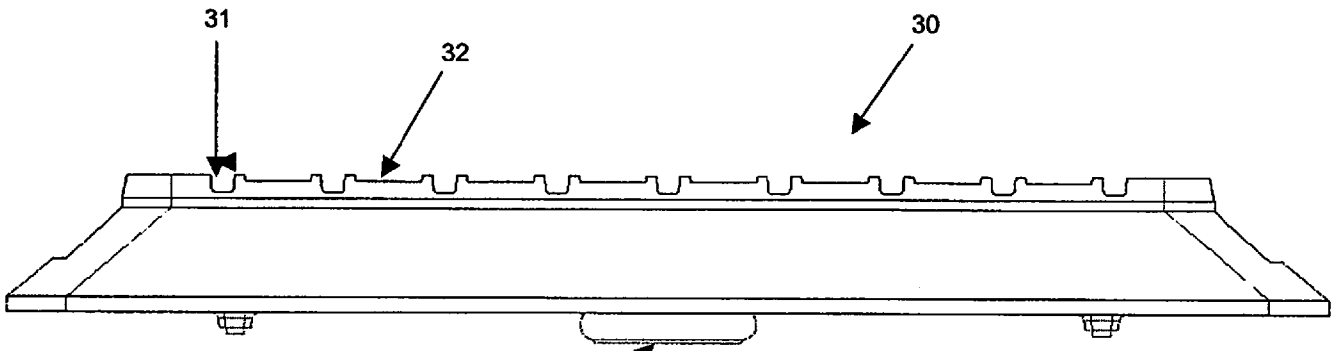
FIG. 6 is a front view of the burner of the present invention.

The geometry of the ports is described below. FIG. 6 shows a front view of the satellite burner 2, showing the used port geometry. Said geometry has three types of ports: a main port 31, which supplies a long and stable flame, a second port 32, which complements the primary port 31, and supplying flame transfer between the primary or principal ports 31, and a flame transfer port 36 located in the end or ends of the port zone 30, in the closest end to the main burner 1, which supplies a long flame igniting when burners 1 and 2 have a maximum fuel flow, being the function of the flame transfer port 36 obtaining a flame from the principal burner 1 and transmitting the flame through the port zones 30 of the satellite burner 2. FIG. 6 also shows the port zone 30 of the satellite burner 2, where it may be seen that the primary ports 31 have a semi-rectangular form, wherein its base is less than its height. The edges wherein the horizontal base is joined with its vertical sides, which determine its height, are rounded. The sides are not totally perpendicular to the base, having approximately one to three grades of inclination. The semi-rectangle is closed when placing the cap 9 of the satellite burner 2, wherein the construction relation of the semi-rectangle is that the height of the sides must be between 15% to 40% larger than the base dimension.

Figure 6B:
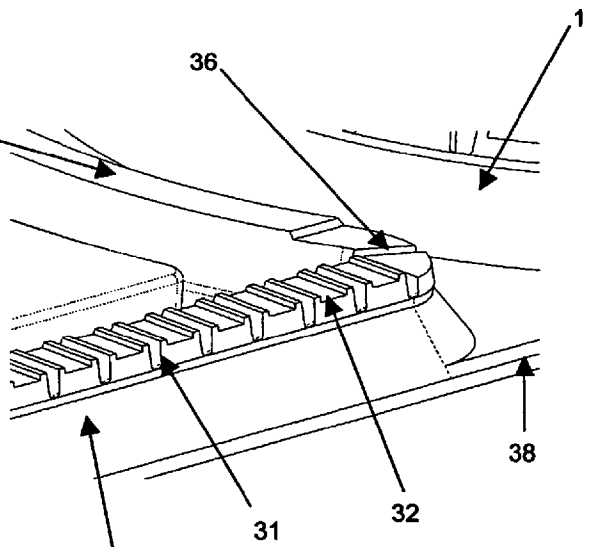
FIG. 6*b* is a partial lateral/front isometric view of the burner of the present invention and a main burner.
Figure 6A:
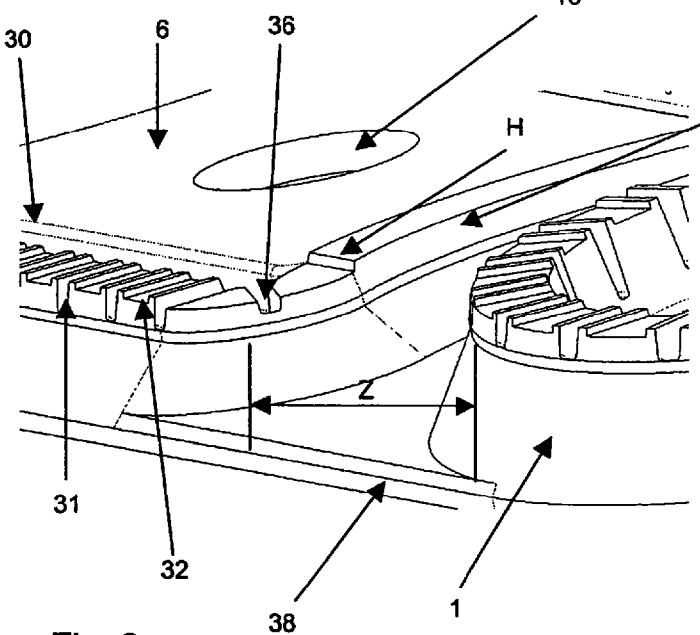
FIG. 6*a* is a partial lateral/rear isometric view of the burner of the present invention and a main burner.

FIG. 6, taken with FIGS. 6*a* and 6*b*, show that the geometry of the secondary ports 32, which have a lesser area than the primary ports 31, also look like a rectangle, except that when compared to the principal ports 31, the base is longer than its sides, having thus a height relation with the sides of between 5% to 20% of the base dimension. As the primary ports 31, the open side of the rectangle is closed when placing the cap 9 of the satellite burner 2. The distance between principal ports 31 must be in the range of between 4 mm (0.157 inches) and 8 mm (0.315 inches), wherein in the upper face of this separation the secondary ports 32 are located, as shown in FIGS. 6, 6*a* and 6*b*.

The transfer ports 36 are located in the end of the port zone 30 closest to the main burner 1. These ports have a peculiar construction, since they may be ignited with a flame dart of the main burner 1, located in the two most proximal ends to the main burner 1. FIG. 6*a* allows appreciating that the transfer port 36 has a valley of about 0.05 mm (0.00197 inches) to 1.5 mm (0.0591 inches) lower than the highest part of the port distance, dimension denominated as H highlighted in FIG. 6*a* with a horizontal fan of between 70° to 110° from the principal port 31 closest to the coinciding center with the arc formed in the end of the port zone 30 and the closest end of the frontal side 14 of the satellite burner 2.

The distance between the lateral side 14 of the satellite burner 2 and the closest part of the main burner 1 is represented by dimension Z, which is calculated partially with respect to the longitude of the flame darts of the main burner 1, so that no interference or objects hindering the path of the dart exist, so that a correct combustion and formation of the flame dart is provided. Therefore, Z dimension must oscillate between seventeen mm. (0.669 inches) to thirty two mm. (1.26 inches). Furthermore the dart emitted by the flame transfer port 36 has an approximate dimension of between four mm. (0.157 inches) to nine mm. (0.354 inches). A flame dart emitted by a principal port 31 of main burner 1 measures between fourteen mm. (0.551 inches) to eighteen mm. (0.709 inches), and thus, Z dimension apart from the flame longitude and flame transfer configuration criteria, is also due to a burner 1 and 2 separation relation, that allows these to develop adequately their respective darts and allow sufficient secondary air to these, to obtain the right combustion.

Figure 7:
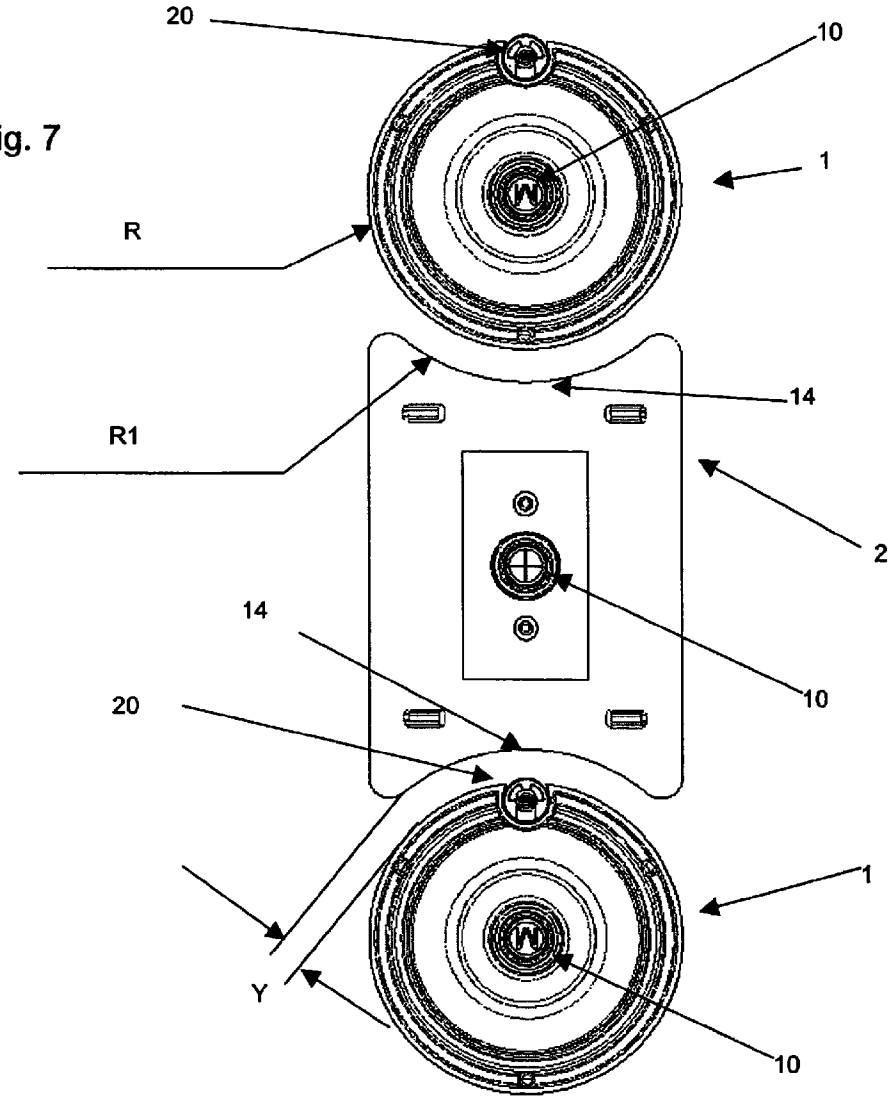
FIG. 7 is an inferior view of a possible burner configuration.

As shown in FIG. 7, the satellite burner 2 has a limited length in regards to radius R of the main burner 1. The maximum length distance of the main burner, is limited, in this embodiment, by radius R of main burner 1 and radius $R_1$ of the opposed main burner 1 and a predetermined Y distance so that the functioning of the three burners 1, 2, 1' may be appropriate when lit at the same time.

Distance Y avoids that the flames of the main burner 1 and satellite burner have interference between themselves, even when both main burners 1 and 1' and the satellite burner 2 are lit. If the flames are crossed, it would cause a bad flame appearance and a greater carbon monoxide production, and thus a poor efficiency and combustion. Distance Y in any case must not be less than fifteen mm. (0.591 inches), however, the greater this distance is, more secondary air around the flame darts there will be.

The wide of the satellite burner 2, is the same as the diameter of the main burner 1, being equal to two times the dimension of the R radius. The arc segments 14 of the main burner 2, do not have ports, except for the flame transfer port 36 in the end. The above, to avoid flame contact between the main burner 1 and the secondary burner 2. Once the cap 9 is placed on the satellite burner 2, the arc segments 14 of the satellite burner 2 are sealed, thus not allowing gas exit in the satellite burner 2, except through the ports 31, 32 and 36.

Second Embodiment of the Invention

Figure 8:
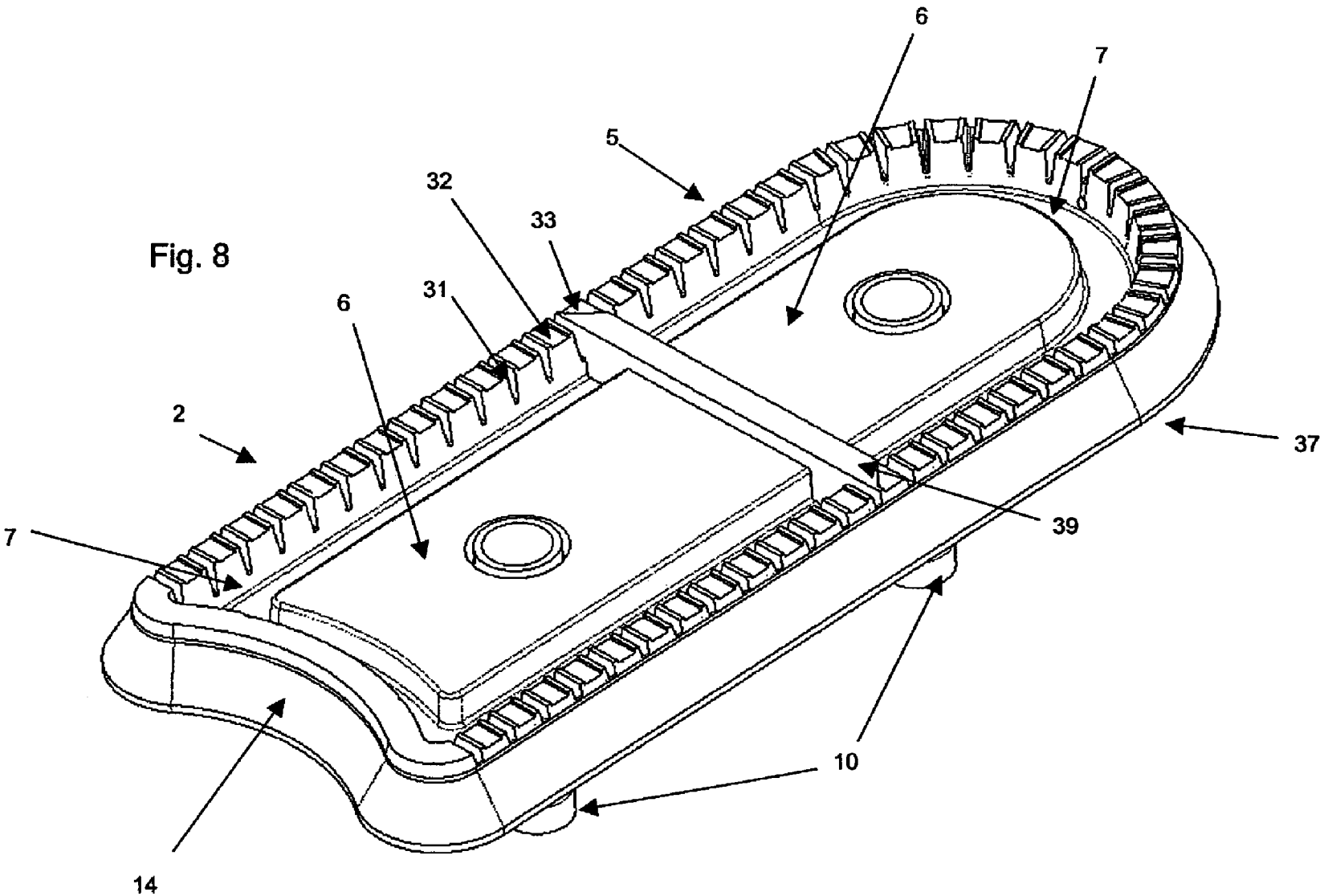
FIG. 8 is an isometric view of a second embodiment of the burner of the present invention.

FIG. 8 shows a second embodiment of the burner of the present invention. Main burner 1 has modified its form to a kind of horse-shoe. Over the periphery of this horse-shoe the port zone 30 is found. Once moved the circular form of the main burner 1 to this new horse-shoe form, we shall call this burner to distinguish it as horse-shoe main burner 5. When fusing the horse-shoe main burner 5 with the secondary burner 2, a body 37 is obtained, with semi-rectangular form in the front of two burners 5, 2 and with the lateral ends in semicircular form.

The horse-shoe main burner 5 and the satellite burner 2, are fused in the same body 37, having an advantage when both burners 5, 2 are assembled, produced, maintained and installed.

In a descriptive however not limitative manner, a port design as was disclosed for the before embodiment may be considered. As shown in FIG. 8, the arc segment 14 of the satellite burner 2 does not have ports, thus no flame is emitted in said zone. Between the satellite burner and the horse-shoe main burner 5, a separation 39 is found, so that the gas emitted by valve 15 with double fuel exit connected to both burners 5, 2, does not pass between burners 5, 2, achieving igniting the horse-shoe main burner 5 first and using only this heating zone. Additionally, if further rotation to the knob of the regulating valve 15 of double fuel output is done, the satellite burner 2 will also be ignited. In this embodiment, a tertiary port 33, previously disclosed as flame transfer port, is found provided of a groove starting from an interior point towards an exterior point and occupying the whole portion of the separation 39. The groove finishes in the same separation 39, since when arriving to the satellite burner 2 side, the fuel fluid emitted by the respective valve 15 could pass from the horse-shoe main burner 5 to the satellite burner 2 or vise versa, igniting both burners at the same time, which is not a desired effect. Therefore, the groove cut is close to the separation 39. The grooves in each side, serve as tertiary ports 33, wherein the tertiary port 33 transfers the flame between the horse-shoe main burner 5 and the satellite burner 2.

As in other embodiments, the flame emitted by the tertiary port 33, given its configuration, will ignite the principal port 31 closest to the tertiary port 33, the flame will then ignite the secondary port 32 closest to the tertiary port 33, the sequence repeating until all the primary 31 and secondary 32 ports are ignited.

Figure 9:
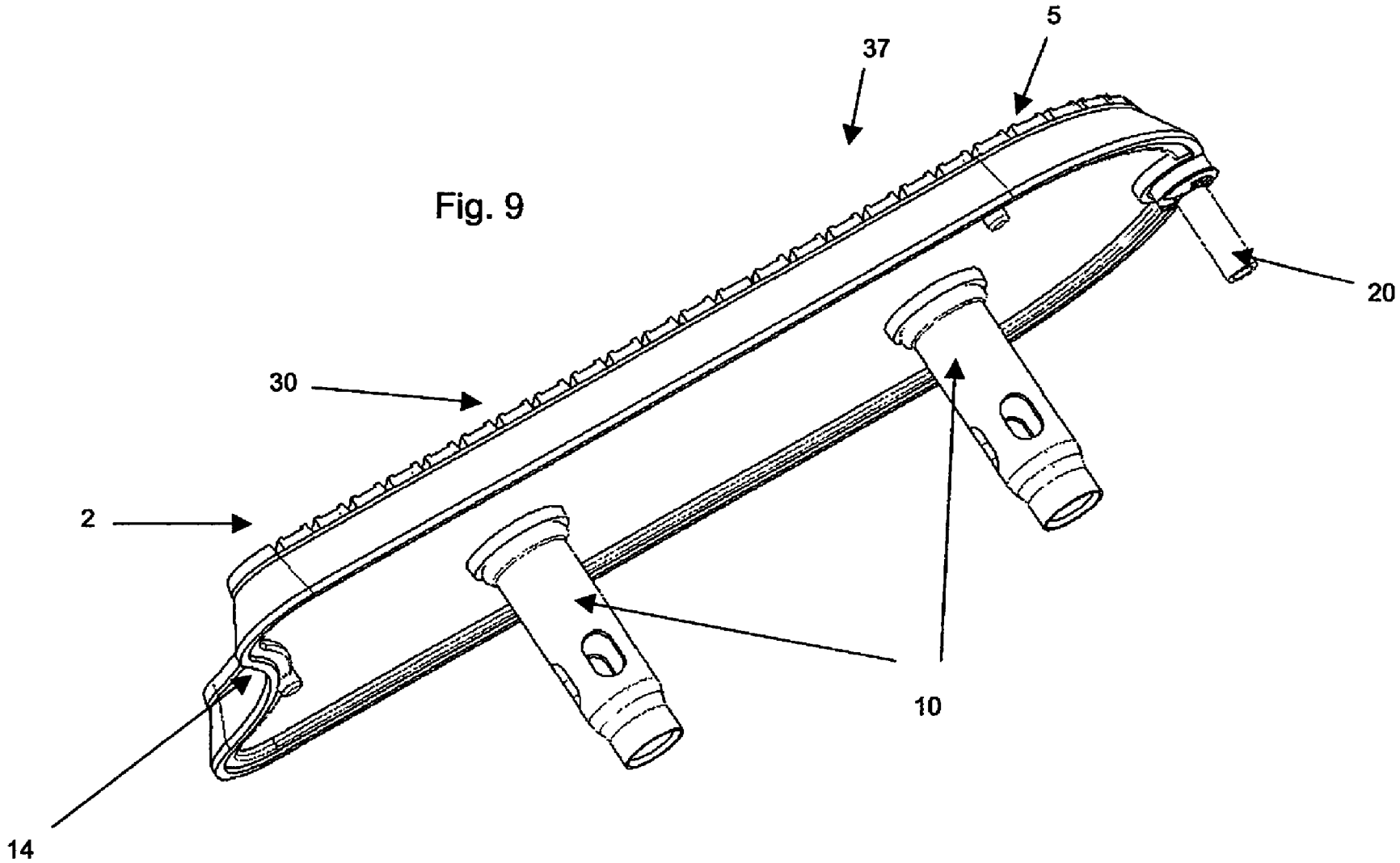
FIG. 9 is an isometric inferior view of the second embodiment of the burner of the present invention.

The ignition of the second embodiment is similar to the satellite burner disclosed in the first embodiment, since it contains a double flow regulating valve 15 and a single spark 22, as is shown in FIG. 9. However, it is possible that the burner has independent regulating flow valves, as was mentioned for the first embodiment of the invention.

Figure 10:
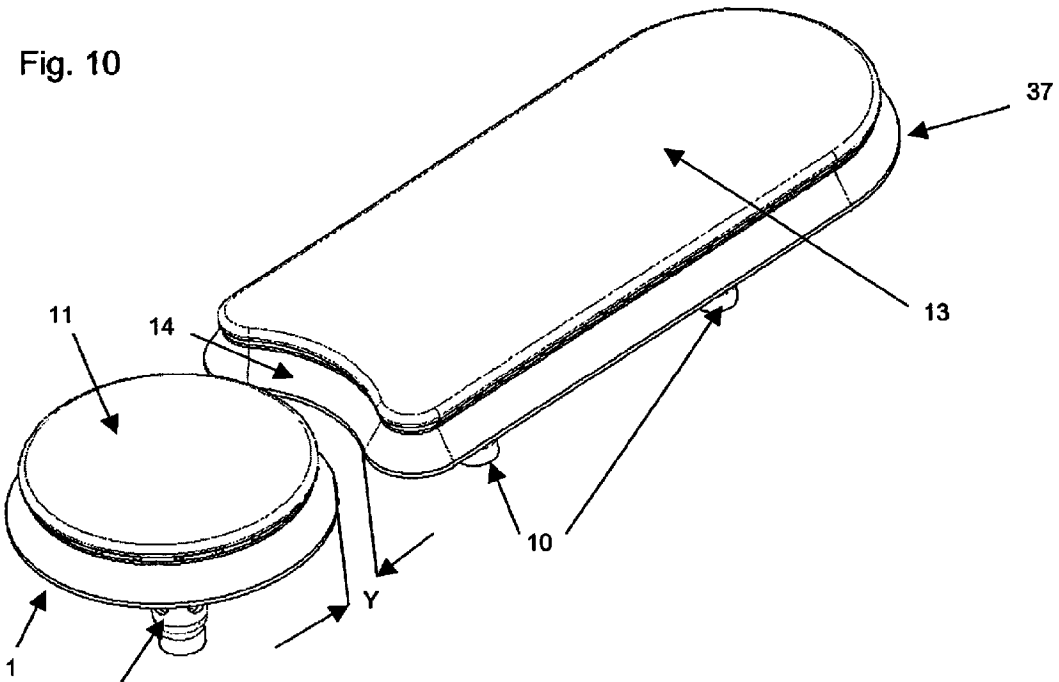
FIG. 10 is an isometric view of a possible burner configuration of the second embodiment.
Figure 10A:
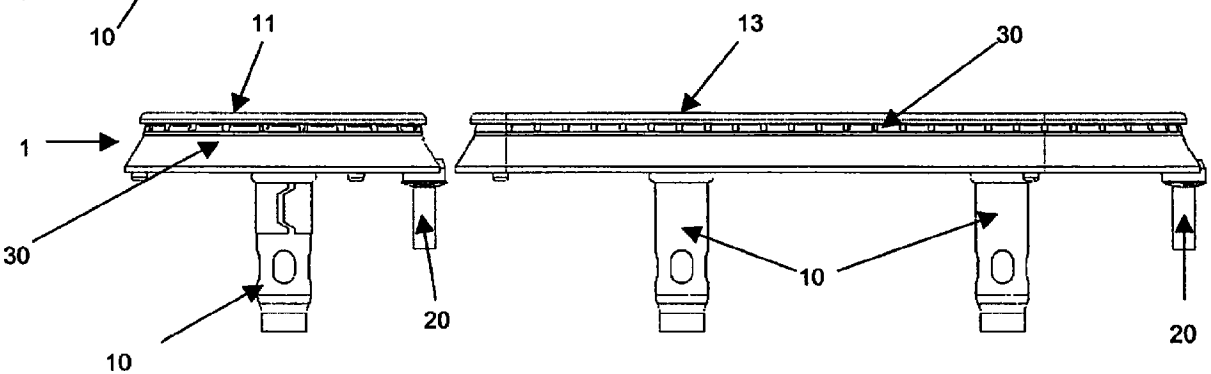
FIG. 10*a* is a front view of a possible burner configuration of the second embodiment.

In FIG. 9, which is an isometric inferior view of the body 37 made up by the fusion of a horse-shoe main burner 5 and a satellite burner 2, it may be appreciated that said burners 1 and 2, each have their feeding tube 10. The horse-shoe main burner 5 has a igniting spark 20. Other characteristics that both burners have when fusing in the body 37 are the burner chambers 7 and the plateaus 6, as shown in FIG. 8, sharing both burners a cap 13, as is illustrated in FIG. 10. FIG. 10 shows another operation mode of the fused body 37 burners, when including in the range cover a main round burner 1, wherein as discussed for the first embodiment, dimension Y must maintain its relation with the characteristics disclosed for the first embodiment of the invention, such as that the dimension must not be less that fifteen mm. (0.591 inches), and that the greater the distance is from the main burner 1 of the body of the fused burners, the better, for secondary air supply reasons, as well as dart interference. FIG. 10*a* shows a front view of the main burner 1 with the body 37 of the fused burners 5 and 2 arrangement, wherein both, the main burner 1, as well as the body 37 of fused burners 5 and 2, each maintain a spark 20, and thus not necessary to keep dimension z discussed for the first embodiment of the invention, since the flame transfer ports 36 are not necessary. Either way, in FIG. 10*a* it may be appreciated that the mixing tubes 10 that feed the three chambers 7 of the burners are independent in each case.

Third Embodiment of the Invention

With the fusion of both burners in a single body 37, a main burner 1 and a satellite burner are joined again in a single body, providing the advantages of: manufacture, assembly, maintenance and less part numbers to handle.

Figure 11:
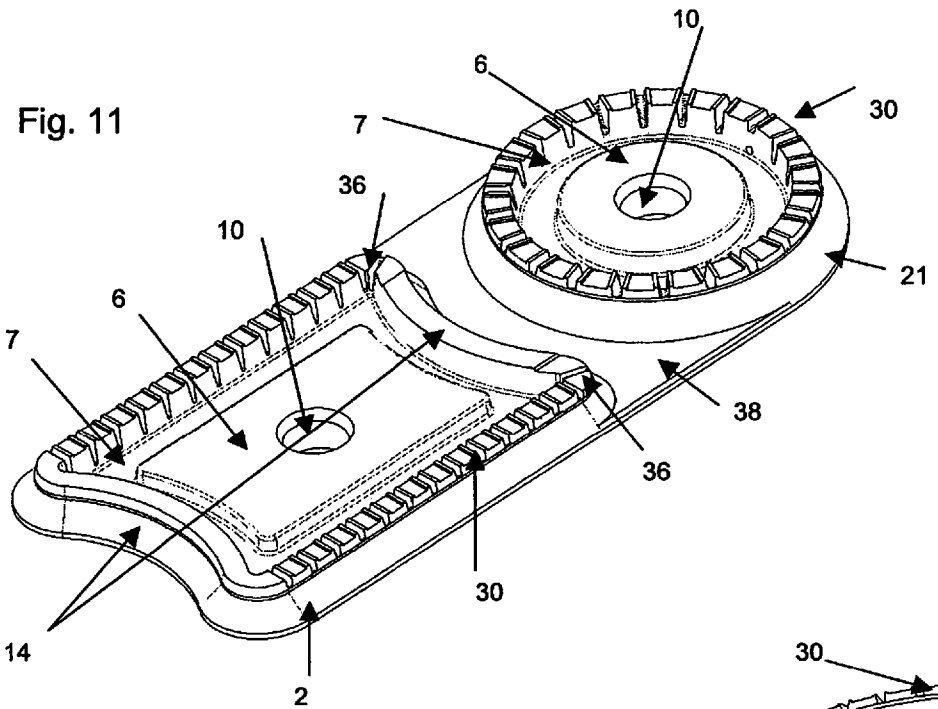
FIG. 11 is an isometric view of a third burner embodiment of the present invention.
Figure 11A:
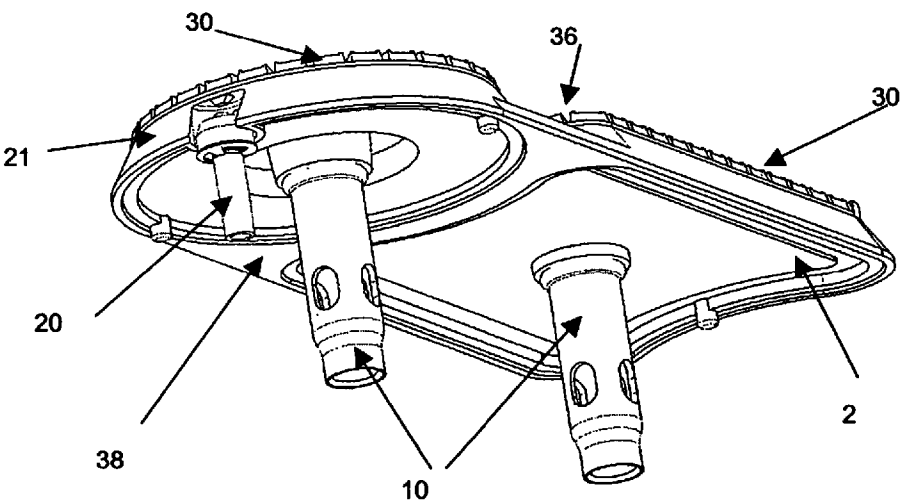
FIG. 11*a* is an inferior isometric view of the third embodiment of the present invention.

The main burner 1 and the satellite or secondary burner 2, are cinched in a single base 38, wherein the fused main burner 1 will be called circumcised main burner 21. As seen in FIGS. 11 and 11*a*, said circumcised main burner 21 retains its port zone 30, spark 20, plateau 6, chamber 7 and cap 11, with the peculiarity of being joined to the satellite burner by means of a base 38, allowing having both burners 21 and 2 contained in a single piece. Therefore, the secondary burner 2 also retains its port zone 30, plateau 6, chamber 7, cap 12 and a pair of flame transfer ports 36 in its ends of the port zone 30 closest to the circumcised main burner 21, such as was disclosed for the first embodiment of the invention. Said description is here assented as if read by letter.

As in the first embodiment, distance Z which refers to the distance between the flame transfer port 36 of the satellite burner 2 and principal port 31 closest to the circumcised main burner 21, shall keep the same punctual features, such as distance Z refers to a distance between circumcised main burner 21 and satellite burner 2, and is in function of the flame dart length of the circumcised main burner 21 and the flame dart length emitted by the flame transfer port 36 of satellite burner, so that no interference or objects hindering or the wall of the secondary burner the path of the dart exist, considerations that must be taken into account when determining the separation of the circumcised main burner 21 and the secondary burner 2 cinched to the base 38. These considerations are done taking both burners in the same horizontal level, that is, that the port zone 30 of both burners 21 and 2, are co-lineal as illustrated in FIG. 12, in which an a-a axis has been disposed for better reference.

Figures 12, 12A, 12B:
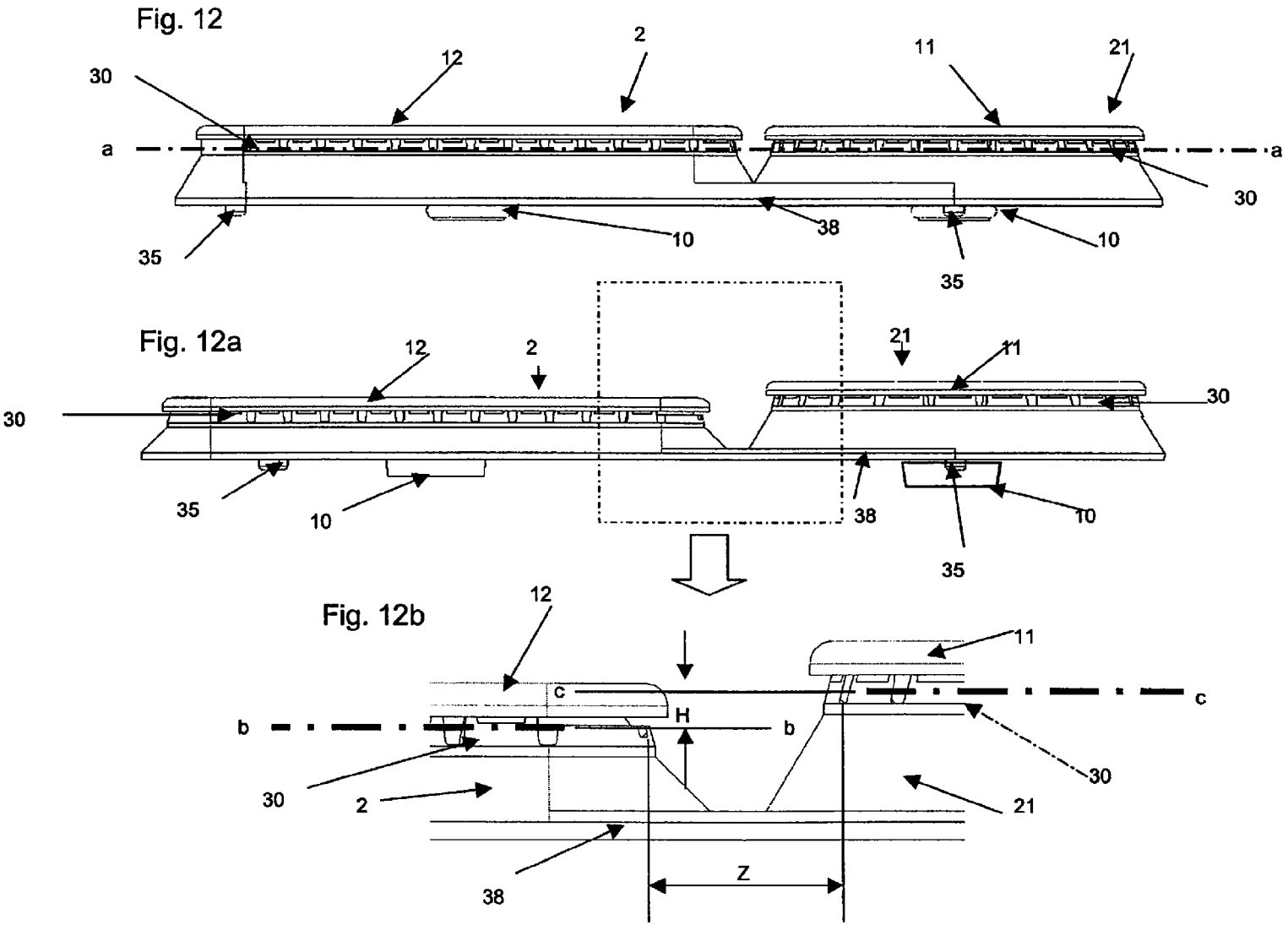
FIG. 12 is a front view of a possible burner configuration in the third embodiment.
FIG. 12*a* is a front view of an embodiment of the possible burner configuration in the third embodiment.
FIG. 12*b* is a detailed view of FIG. 12*a*.

A further embodiment of the invention is show in FIG. 12*a*, when the port zone 30 of both burners 21, 2 are not co-lineal, and as observed in said figure, the circumcised main burner 21 has a greater height than the satellite burner 2. This configuration obeys to a distance optimization between burners, as well as a better space accommodation. When having a lower distance A in the satellite burner 2, the circumcised main burner 21 avoids flame dart obstructions emitted by the ports of the circumcised main burner 21. Additionally, the elevated position helps improve the combustion, since the flame darts improve the manner in which the necessary secondary air arrives, improving thus efficiency and heat transference, since the circumcised main burner 21 is closer to the cooking utensils.

FIG. 12*a* shows a detailed view of FIG. 12*b*, wherein the height difference A is highlighted by axis c-c and b-b whose vertical difference represents dimension A. Said axis c-c and b-b in relation to port geometries, are construed taking into reference a point reference of the ports, as is their symmetry axis, valley, peak, etc. Distance A obeys to the flame dart height that due to efficiency and combustion criteria, is preferable to find the darts uneven, wherein A is preferably between three mm. (0.118 inches) to five mm. (0.197 inches).

Figure 13A:
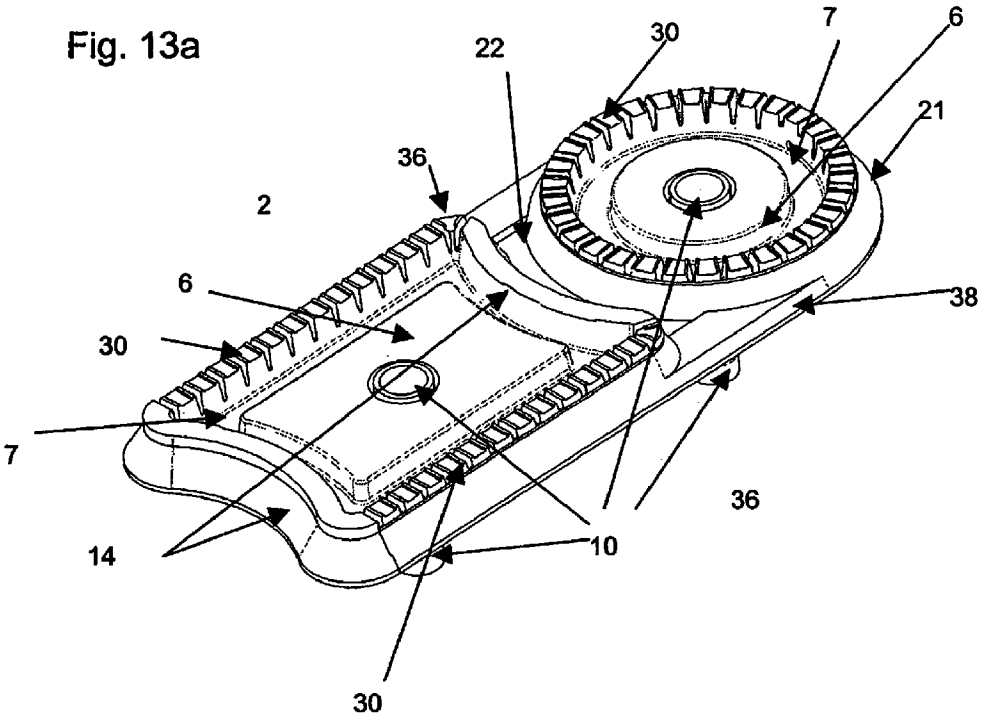
FIG. 13*a* is an isometric view of the second embodiment in the possible burner configuration of the third embodiment.

A further embodiment as seen in FIG. 13*a* is when including a window 22 in the base 38 in the zone between burners 21 and 2. The window is accompanied by a certain separation between the base of burners 21 and 2, and the range or cook cover, allowing the flow between the inferior part of the base 38 and the range or cook cover over which burners 21 and 2 are mounted, creating an air flow which takes advantage of by the flame darts of the circumcised main burner 21 emitted in the zone between the satellite burner 2 and the own circumcised main burner 21, helping secondary air supply to the flame darts.

Figure 13B:
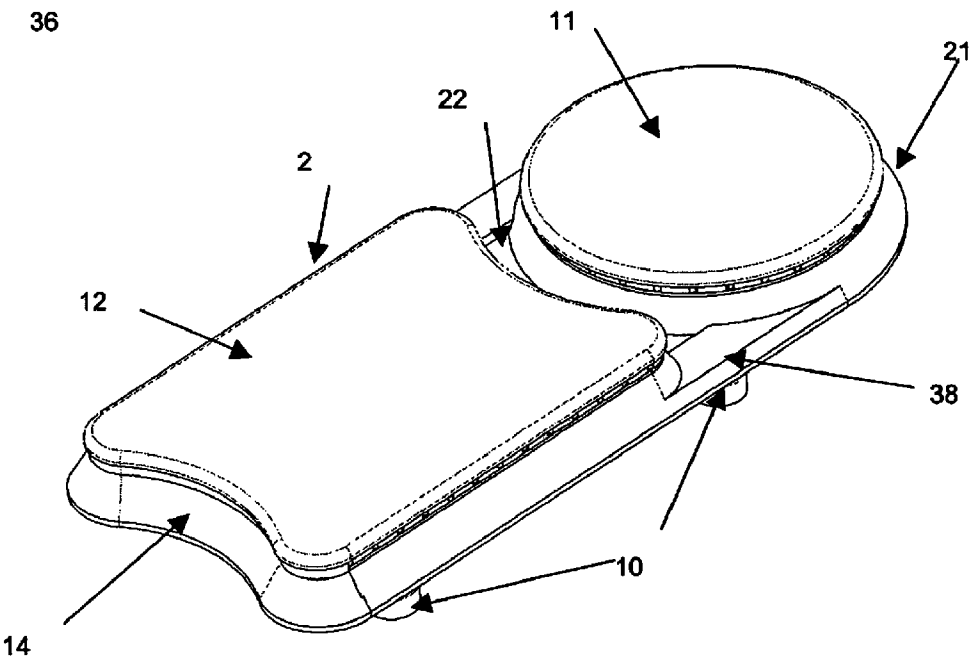
FIG. 13*b* is a second isometric view of the second embodiment in the possible burner configuration of the third embodiment.

FIG. 13*b* shows an isometric view of the third embodiment of the present invention, with the window which helps supplying secondary air to the ports in this zone of the circumcised main burner 21. Said main burner 1 shows a cap 11 that is supported by the port zone 30 and closes the burner chamber 7. Said figure also shows the satellite burner having a cap 12 that closes the burner chamber 7 which is also supported by the port zone 30 and sealing the arc segments 14 of the satellite burner 2.

It should be noted that burners 21 and 2 may be fed each one by an independent flow regulating valve. Furthermore, burners 21 and 2 may be controlled by a double exit fuel valve 15, wherein the functioning is similar to that disclosed for the first embodiment of the present invention wherein said discussion is hereby inserted as if read by letter.

Figure 14B:
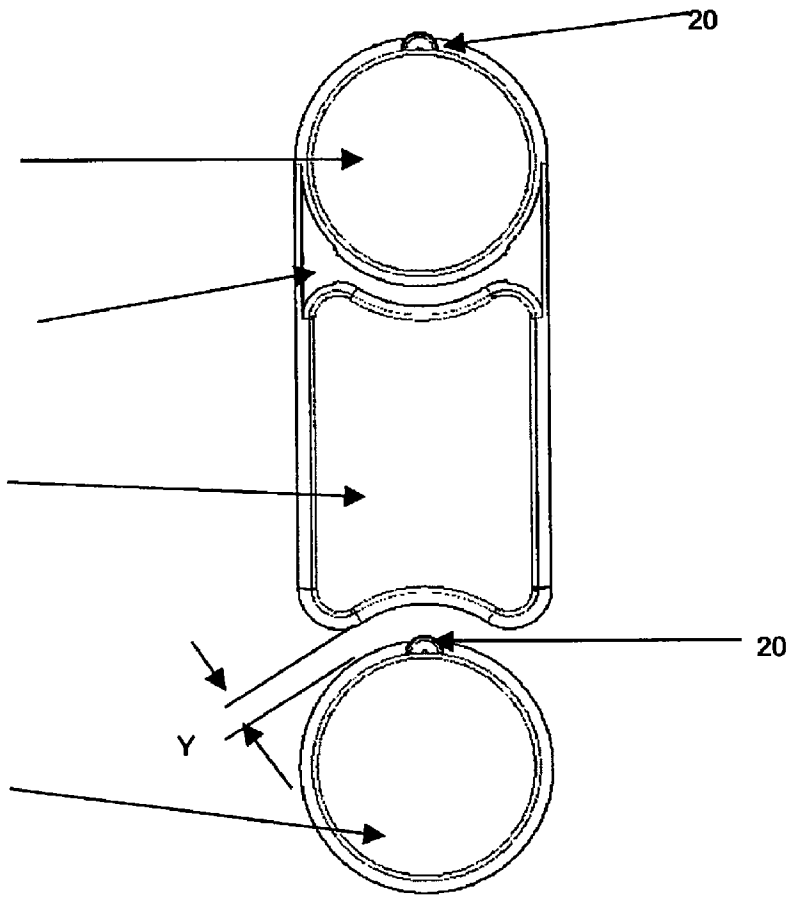
FIG. 14*b* is a superior view of the first embodiment in the possible burner configuration of the third embodiment.
Figure 14A:
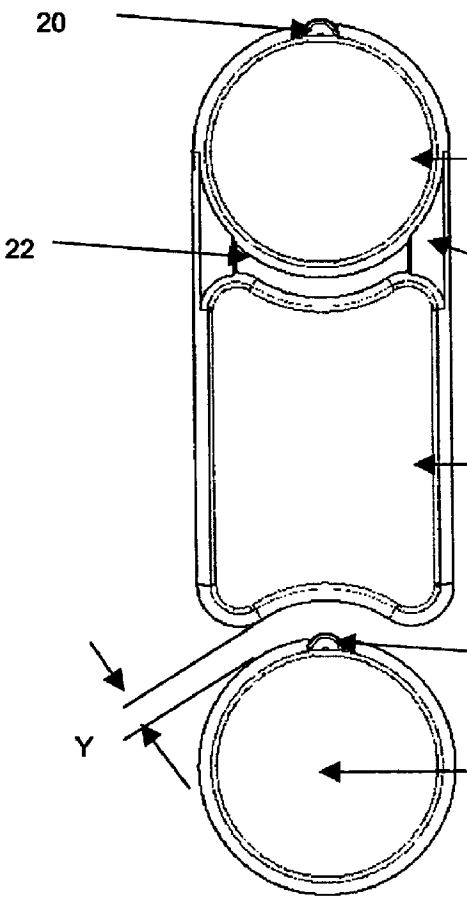
FIG. 14*a* is a superior view of the second embodiment in the possible burner configuration of the third embodiment.

FIGS. 14*a* and 14*b* show a further condition of the present embodiment, which gives place when accommodating over the range cover or burners, a main burner 1 at a determined Y distance, in knowing that this dimension must not be less than fifteen mm. (0.591 inches), and the greater the distance between the main burner 1 and burners 2, 21 cinched to the base 38, the better, due to secondary air supply reasons, as well as dart interference. Said main burner 1 operates in an independent manner to burners 21, 2 joined over a base 38. FIG. 14*a* shows the window 22 peculiarity, whereas FIG. 14*b* does not show said peculiarity.

All the configurations and embodiments of burners and burner assemblies mentioned afore, may be used in ranges, grates, stoves or similar.

Alterations to the disclosed structure in the present specification, may be predicted by those skilled in the art. However, it should be understood that the present specification is related with the preferred embodiments of the invention, which is for illustrative purposes only, and should not be construed as a limitation of the invention. All the amendments that do not depart from the spirit of the invention shall be included within the scope of the attached claims.

What is claimed is:

1. A gas burner comprising:

a tube mixer adapted to mix a gas fuel with air;

an internal chamber comprising an internal plateau configured to reduce chamber volume and increase a flow rate of a mixture from the tube mixer;

a cap over the internal chamber;

one or more port zones in the periphery of the internal chamber, comprising two or more principal ports, two or more secondary ports complementing said principal ports and allowing flame transfer between the principal ports; and one or more flame transfer ports located in at least one of the ends of said one or more port zones and each configured to produce a flame dart;

wherein said principal ports have a port area in a range from 0.00775 square inches to 0.0109 square inches;

wherein said secondary ports have a substantially constant port area in a range from 0.00465 square inches to 0.0093 square inches; and wherein said flame transfer ports have a port area in a range from 0.00155 square inches to 0.00465 square inches;

wherein each principal port comprises a principal port longitudinal axis, wherein each flame transfer port comprises a flame transfer port longitudinal axis, and wherein an angle between a flame transfer port longitudinal axis and an adjacent principal port longitudinal axis within a same port zone is different than angles between adjacent principal port longitudinal axes in the same port zone, and wherein the flame transfer port longitudinal axis is angled to diverge away from the adjacent principal port longitudinal axis and toward another gas burner so that the flame transfer port is conducive to a flame transfer between the gas burner and said another gas burner wherein each flame transfer port comprises a groove concentric with the flame transfer port longitudinal axis and disposed within a horizontal fan, wherein the horizontal fan spans between 70 and 100 degrees from the adjacent principle port longitudinal axis.

2. The burner in accordance to claim 1, further comprising:

at least one long side and at least one perpendicular side;

wherein said long side of the burner is straight and said perpendicular side is an arc segment;

wherein the port zone is located in said long side.

3. The burner in accordance to claim 1, wherein said burner additionally comprises support ingots to support the burner body.

4. The burner in accordance to claim 1, wherein the total port area of said principal, secondary and flame transfer ports ranges from 0.155 square inches to 0.465 square inches.

5. The burner in accordance to claim 1, wherein the principal ports are semi-rectangular and their base is less than the height of the side;

wherein said sides have an angular inclination ranging from 1° to 3°, wherein said height of the sides is from 15% to 40% larger than the base dimension;

wherein the secondary ports are semi-rectangular and their base is greater than the height of the side;

wherein said sides of the secondary ports have an angular inclination in a range from 1° to 3°;

wherein said height of the sides of the secondary ports is from 5% to 20% larger than the base dimension.

6. The burner in accordance to claim 1, wherein the flame transfer port comprises a valley defined at least in part by a height (H) dimension;

wherein H ranges from about 0.00197 inches to about 0.0591 inches lower than the highest part of said flame transfer port;

wherein H has a horizontal fan ranging from 70° to 110° to the closest principal port with the coinciding center of the arc segment;

wherein the flame transfer port comprises a groove concentric with the flame transfer port longitudinal axis from an interior point to an exterior point, occupying the entire portion of a separation; and wherein the groove finishes over the separation.

7. A cooking device including the burner of claim 1.

8. A gas burner assembly comprising:

at least one main burner including a tube mixer adapted to mix a gas fuel with air;

a spark igniter;

a main burner internal chamber comprising an internal plateau configured to reduce chamber volume and increase a flow rate of a mixture from the tube mixer;

two or more principal ports and two or more secondary ports in the periphery of the main burner internal chamber, complementing the principal port and allowing flame transfer among principal ports; and at least one secondary burner including a tube mixer adapted to mix a gas fuel with air;

a secondary burner internal chamber comprising an internal plateau configured to reduce chamber volume and increase a flow rate of a mixture from the mixture tube of the secondary burner;

a cap over the secondary burner internal chamber;

one or more port zones in the periphery of the secondary burner internal chamber, comprising two or more principal ports each configured to produce a principal port flame dart, two or more secondary ports complementing the principal port and allowing flame transfer between principal ports; and one or more flame transfer ports located in at least one of the ends of the one or more port zone and each configured to produce a flame transfer port flame dart that is shorter than the principal port flame dart;

wherein the main burner and the secondary burner are fused in a single body of the burner assembly;

wherein said principal ports of said secondary burner have a port area ranging from 0.00775 square inches to 0.0109 square inches;

wherein said secondary ports of said secondary burner have a substantially constant port area ranging from 0.00465 square inches to 0.0093 square inches; and wherein said flame transfer ports of said secondary burner have a port area ranging from 0.00155 square inches to 0.00465 square inches;

wherein each principal port comprises a principal port longitudinal axis, wherein each flame transfer port comprises a flame transfer port longitudinal axis, and wherein an angle between a secondary burner flame transfer port longitudinal axis and an adjacent secondary burner principal port longitudinal axis is different than angles between adjacent secondary burner principal port longitudinal axes, and wherein the flame transfer port longitudinal axis is angled to diverge away from the adjacent principal port longitudinal axis and toward the main burner so that the flame transfer port is conducive to a flame transfer between the secondary burner and the main burner wherein each flame transfer port comprises a groove concentric with the flame transfer port longitudinal axis and disposed within a horizontal fan, wherein the horizontal fan spans between 70 and 100 degrees from the adjacent principle port longitudinal axis.

9. The burner assembly in accordance to claim 8, comprising a window through the single body between the main burner and the secondary burner body, the main burner and secondary burner comprising at least one support ingot, said ingots along with said window allow a separation between the burner body and a range or stove cover, thus allowing air circulation.

10. A gas burner assembly comprising:

at least one round main burner including a tube mixer adapted to mix a gas fuel with air;

a spark igniter;

a round main burner internal chamber comprising an internal plateau configured to reduce chamber volume and increase a flow rate of a mixture from the tube mixer;

a plurality of principal ports each configured to produce a principal port flame dart and a plurality of secondary ports along an entire periphery of the round main burner internal chamber, the secondary ports complementing the principal port and allowing flame transfer among principal ports; and at least one secondary burner including a tube mixer adapted to mix a gas fuel with air;

a secondary burner internal chamber comprising an internal plateau configured to reduce chamber volume and increase a flow rate of a mixture from the mixture tube of the secondary burner, wherein a secondary burner internal chamber periphery comprises an arc segment adjacent the main burner and separated from the secondary burner by an arcuate gap of a constant dimension;

a round main burner cap over the round main burner internal chamber;

a secondary burner cap over the secondary burner internal chamber;

a plurality of principal ports and a plurality of secondary ports disposed in the periphery of the secondary burner internal chamber but not in the arc segment, the secondary ports having substantially constant port area complementing the principal port and allowing flame transfer among principal ports; and one or more flame transfer ports located in the arc segment configured to produce a flame transfer port flame dart that is shorter than the principal port flame dart;

wherein the main burner and the secondary burner are fused in a single body of the burner assembly;

wherein each principal port comprises a principal port longitudinal axis, wherein each flame transfer port comprises a flame transfer port longitudinal axis, and wherein an angle between a secondary burner flame transfer port longitudinal axis and an adjacent secondary burner principal port longitudinal axis is different than angles between adjacent secondary burner principal port longitudinal axes, and wherein the flame transfer port longitudinal axis is angled to diverge away from the adjacent principal port longitudinal axis and toward the round main burner so that the flame transfer port is conducive to a flame transfer between the secondary burner and the round main burner.

11. A gas burner assembly comprising:

at least one round main burner including a tube mixer adapted to mix a gas fuel with air;

a spark igniter;

a round main burner internal chamber comprising an internal plateau configured to reduce chamber volume and increase a flow rate of a mixture from the tube mixer;

a plurality of principal ports each configured to produce a principal port flame dart and a plurality of secondary ports along an entire periphery of the round main burner internal chamber, the secondary ports complementing the principal port and allowing flame transfer among principal ports; and at least one secondary burner including a tube mixer adapted to mix a gas fuel with air;

a secondary burner internal chamber comprising an internal plateau configured to reduce chamber volume and increase a flow rate of a mixture from the mixture tube of the secondary burner, wherein a secondary burner internal chamber periphery comprises an arc segment adjacent the main burner and separated from the secondary burner by an arcuate gap of a constant dimension;

a round main burner cap over the round main burner internal chamber;

a secondary burner cap over the secondary burner internal chamber;

a plurality of principal ports and a plurality of secondary ports disposed in the periphery of the secondary burner internal chamber but not in the arc segment, the secondary ports having substantially constant port area complementing the principal port and allowing flame transfer among principal ports; and one or more flame transfer ports located in the arc segment configured to produce a flame transfer port flame dart that is shorter than the principal port flame dart; and wherein the flame transfer port longitudinal axis is angled to diverge away from the adjacent principal port longitudinal axis and toward the round main burner so that the flame transfer port is conducive to a flame transfer between the secondary burner and the round main burner.

* * * * *

UNITED STATES PATENT AND TRADEMARK OFFICE

CERTIFICATE OF CORRECTION

PATENT NO. : 8,011,358 B2
APPLICATION NO. : 12/034035
DATED : September 6, 2011
INVENTOR(S) : Victor Gerardo Caloca Galindo It is certified that error appears in the above-identified patent and that said Letters Patent is hereby corrected as shown below:

Column 11, line 6, replace “100” with -- 110 --.

Column 11, line 7, replace “principle” with -- principal --.

Column 12, line 35, replace “100” with -- 110 --.

Column 12, line 35, replace “principle” with -- principal --.

Signed and Sealed this
Tenth Day of April, 2012

David J. Kappos

David J. Kappos
*Director of the United States Patent and Trademark Office*